United States Patent [19]

Bennett et al.

[11] 4,042,348

[45] Aug. 16, 1977

[54] METHOD OF CONDITIONING FLUE GAS TO ELECTROSTATIC PRECIPITATOR

[75] Inventors: Robert P. Bennett, Bridgewater; Matthew J. O'Connor, Flanders; Alfred E. Kober, Hopatcong; Ira Kukin, West Orange, all of N.J.

[73] Assignee: Apollo Chemical Corporation, Whippany, N.J.

[21] Appl. No.: 710,582

[22] Filed: Aug. 2, 1976

[51] Int. Cl.[2] ..... B03C 1/00

[52] U.S. Cl. ..... 55/5; 55/11; 423/215.5

[58] Field of Search ..... 423/242, 244, 215.5; 55/5, 11, 107

[56] References Cited

U.S. PATENT DOCUMENTS

| | | | |
|---|---|---|---|
| 1,446,778 | 2/1923 | Witte | 55/5 |
| 3,665,676 | 5/1972 | McKewen | 55/122 |
| 3,822,339 | 7/1974 | Mizuno et al. | 423/242 |

OTHER PUBLICATIONS

Dalmon et al., A Comparison of Chemical Additives as Aids to Electrostatic Precipitation of Fly Ash, - In Atmosphere Environment, vol. 6, pp. 721-734, Pergamon Press.

*Primary Examiner*—Bernard Nozick
*Attorney, Agent, or Firm*—James & Franklin

[57] ABSTRACT

The collection characteristics of particles entrained in a particle-laden gas for collection by an electrostatic precipitator are improved by injecting finely divided ammonium bisulfate into a particle-laden gas stream formed by the burning of coal while the gas has a temperature of 590-900° C. Sufficient ammonium bisulfate is injected to provide 75-1250 grams per metric ton of coal burned to form the gas. After injection, the stream is directed through a heat exchange means and finally into the precipitator to collect the particles therein.

28 Claims, 2 Drawing Figures

METHOD OF CONDITIONING FLUE GAS TO ELECTROSTATIC PRECIPITATOR

BACKGROUND OF THE INVENTION

This invention relates generally to the separation of particulate material from a gas stream and particularly to a method of chemically conditioning a particle-laden gas stream so that the particles may be efficiently removed in an electric field.

DESCRIPTION OF PRIOR ART

One conventional way of collecting dust particles from a gas stream in which the particles are entrained is by using an electrostatic precipitator. This apparatus utilizes a corona discharge to charge the particles passing through an electrical field established by a plurality of discharge electrode wires suspended by insulators in a plane parallel to a grounded collecting electrode plate. The charged particles are attracted to the collector plate from which they may then be removed by vibrating or rapping the plate. Examples of this type of precipitator are found in U.S. Pat. Nos. 3,109,720 and 3,030,753.

Dust particles have different collection characteristics depending somewhat upon their source. One such characteristic is resistivity which is measured in ohm-centimeters. For example, where the source of particles is a coal-fired boiler, there is usually a predictable relationship between the type of coal burned and the resistivity of the particles in the flue gas. Typically, low sulphur coal, i.e., less than 1 percent sulphur, produces particles having high resistivity, e.g., $10^{13}$ ohm-centimeters resistance; coal with 3–5 percent sulphur produces particles having $10^8$–$10^{10}$ ohm-cm resistance; and, poor combustion of coal produces particles having $10^4$–$10^5$ ohm-cm resistance.

It has been found heretofore that the most efficient collection or precipitation of particles occurs when their resistivity is about $10^8$–$10^{10}$ ohm-centimeters. When the resistivity is lower than this, e.g., in the collection of highly conductive dusts, the dust particle loses its charge immediately upon reaching the collecting electrode. Once the charge is lost, the particle reentrains back into the gas stream and has to be charged again. This results in a considerable loss of efficiency. Conversely, when the resistivity is higher than this, e.g., in the collection of highly resistive dusts, the dust particles act as electrical insulators and cannot conduct charges on the collected dust layer to the grounded electrode. As this condition progresses, the voltage drop across the dust layer increases, causing a drop in the applied voltage between the high voltage emitting wire and grounded electrode. Since high applied voltage is required to maintain corona current, the current also drops, causing the precipitator performance to deteriorate. As the voltage across the dust layer increases, eventually the dielectric strength of the dust layer is exceeded, back ionization occurs and the precipitator becomes no better than a settling chamber. However, when the particles are of the preferred resistivity, a balance is achieved between the tendency to have either overcharged or undercharged particles and optimum precipitation efficiency results.

The bulk resistivity of the particles to be conditioned can be determined, if desired, by measuring the bulk resistivity of a sample of such particles in accordance with the American Society of Mechanical Engineers Power Test Code No. 28 (ASME PTC 28) entitled "Determining the Properties of Fine Particulate Matter" (paragraph 4.05 describes the "Measurement of Resistivity" and Appendix FIGS. 7–10 describe the apparatus used for measuring the resistivity). Attempts to control the resistivity of the particles have been made with only limited success. For example, to this end, there have been injected into the gas stream various chemicals such as water, anhydrous ammonia, water and ammonia, sulfuric acid, sulfur trioxide, and phosphoric acid. These chemicals have usually been injected for reaction in situ with other chemicals naturally present in the gas stream with the hope that a conditioner would be formed in the gas stream. As a result, the resistivity of the particles in the gas has been of a random and uncontrolled nature and entirely dependent on the chemical composition of the gas and/or particles in the gas. Examples of and references to chemicals injected into the gas stream and the conditioner formed thereby may be found in the following patents: water — U.S. Pat. No. 2,746,563, Great Britain Patent No. 932,895; ammonia — U.S. Pat. No. 1,291,745, U.S. Pat. No. 2,356,717; water and ammonia — U.S. Pat. No. 2,501,435, U.S. Pat. No. 3,523,407; sulfuric acid — U.S. Pat. No. 2,746,563, Great Britain Patent No. 932,895, U.S. Pat. No. 2,602,734; sulfur trioxide — U.S. Pat. No. 2,746,563, Great Britain Patent No. 932,895, Great Britain Patent No. 933,286; and phosphoric acid — U.S. Pat. No. 3,284,990.

U.S. Pat. No. 3,523,407 describes a process for injecting water, ammonia and, when it is not present as a combustion product, $SO_3$, to alter the resistivity of entrained dust and make it easier to collect in an electrostatic precipitator. The water and ammonia are injected, preferably separately, prior to the passage of the flue gas through the preheater in an area where the temperature is at least 400° F (204° C) and preferably at least 450° F (232° C). The disadvantages of this approach are obvious. First, depending on the gas to be treated one needs either two or three complete injection systems, and one must handle at least one and sometimes two toxic gases. Second, a relatively large amount (i.e., 40–80 gals.) of water must be injected per million cubic feet of flue gas, and the amount of water must be varied depending on the $SO_3$ content of the gas being conditioned. Third, the conditioning depends on a chemical reaction occuring in the flue; e.g., a molecule each of ammonia, water and sulfur trioxide combining to form ammonium bisulfate.

U.S. Pat. No. 3,665,676 describes a conditioner solution comprising an aqueous solution of ammonium sulfate or ammonium bisulfate, but specifically teaches that the conditioner solution must be injected into the gas stream only after the air preheater to avoid the tendency of the chemical therein (e.g. ammonium bisulfate) to deposit in and clog the air preheater when the conditioner solution is injected upstream from the air preheater. Such clogging is completely unacceptable because the entire unit must then be shut down to wash the air preheater. By injecting the conditioner solution after the air heater, this problem is overcome; however, the engineering problem of insuring adequate distribution and mixing of the additive with the flue gas prior to the precipitator becomes much more difficult. The flue in a large coal fired boiler can have a cross-sectional area after the air preheater of as large as 1000 sq. ft.; at best, only a few seconds mixing time are available prior to the precipitator, and often there is severe stratification of gas flow in this region. Obviously, the further upstream from the precipitator that the solution can be injected, the better chance of complete mixing; however, the requirement of the patent that injection be downstream of the preheater limits the opportunity for improved mixing. In addition, the turbulence caused by passing the flue gas and conditioner solution through the constrictions of an air preheater would also contribute significantly to mixing; however, the same patent requirement also limits this opportunity for improved mixing.

Yet another drawback of the method described in U.S. Pat. No. 3,665,676 is the relatively large amounts of conditioner solution needed to condition the flue gas. Whether this requirement is a result of inadequate mixing or low activity of the conditioning agent in the 240°-800° F (116°-427° C) temperature range specified for the gas is not clear; however, the disadvantages of having to buy, store and pump large quantities of conditioner solution are clear.

Accordingly, an object of the present invention is to provide an improved method of conditioning a particle-laden gas stream to improve the collection characteristics of the particles entrained therein.

Another object is to provide such a method where only one injection system is needed to inject the conditioning agent.

A further object is to provide such a method where there is no necessity to handle one or more toxic gases.

It is also an object to provide such a method which insures adequate mixing of the conditioning agent with the flue gas by injecting it upstream from the preheater.

It is another object to provide such a method which injects the conditioning agent in such a manner as to insure that it does not deposit upon and plug the preheater.

It is a further object to provide a method which conditions the particle-laden gas stream using a much smaller quantity of conditioning agent than hitherto thought possible.

SUMMARY OF THE INVENTION

It has now been found that the above and related objects of the present invention are obtained by a method of conditioning a particle-laden gas comprising forming a mixture of the particle-laden gas and finely divided ammonium bisulfate where the gas is at a temperature of 590°-900° C and the mixture contains 75-1250 grams of ammonium bisulfate per metric ton of coal burned to form the gas. Preferably the gas is at a temperature of 590°-750° C at the time of mixing, and the mixture contains 150-600 grams of ammonium bisulfate per metric ton of coal burned to form the gas. The ammonium bisulfate may be added to the gas in the form of either a dry powder or an aqueous solution (preferably at a 20-50% ammonium bisulfate concentration by weight).

In a preferred embodiment, the collection characteristics of particles entrained in a particle-laden gas stream are improved for collection by an electrostatic precipitator by injecting finely divided ammonium bisulfate into a stream of particle-laden gas formed by the burning of coal while the gas has a temperature of 590°-900° C. Sufficient ammonium bisulfate is injected to provide 75-1250 grams of ammonium bisulfate per metric ton of coal burned to form the gas. After injection, the gas stream is directed through a heat exchange means and finally into the precipitator to collect the particles therein.

DETAILED DESCRIPTION OF THE PREFERRED EMBODIMENTS

Figure 1:
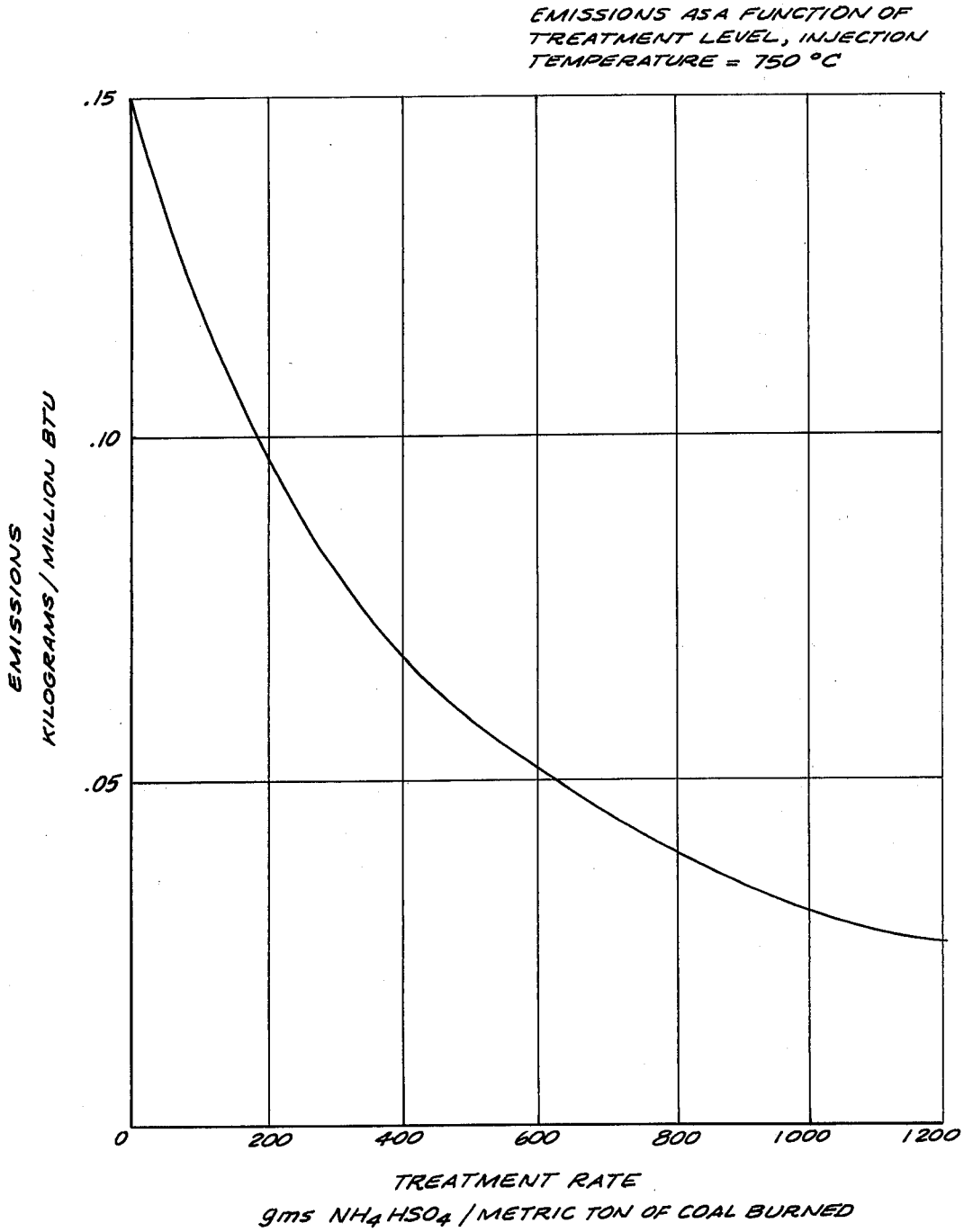
FIG. 1 is a graph illustrating the emission level (kilograms of emissions per million BTU produced) as a function of the treatment level (grams $NH_4HSO_4$ per metric ton of coal burned), at a constant injection temperature of 750° C.

The conditioner useful in the present invention is finely divided ammonium bisulfate ($NH_4HSO_4$). The conditioner may be utilized either in dry form (for example, as a powder of finely divided particles) or preferably as a solution. An aqueous solution can be made by dissolving one kilogram of ammonium sulfate granules and about 730 grams of concentrated sulfuric acid in water. This mixture will yield 1.73 kilograms of ammonium bisulfate in the water. The solution may also be prepared by dissolving ammonium bisulfate, itself, into water or by any other conventional means for preparing an aqueous solution.

The amount of conditioner to be injected into the gas stream at the specified temperature varies according to the amount of solids entrained in the gas stream and the degree of improvement needed in the electrostatic precipitator efficiency, for example, in order to meet a maximum allowable emissions requirement of a local, state or federal regulatory body. Generally for conditioning the fly ash in a coal-burning utility boiler, sufficient conditioner is injected into the gas stream to provide 75-1250, and preferably 150-600 grams of the conditioner agent (i.e., ammonium bisulfate) per metric ton of coal burned to form the gas. Since the flue gas volume is dependent on the temperature of the flue gas, another way of expressing this value is 2.46-41.1, and preferably 4.93-9.71, kilograms of conditioner per million cubic meters of flue gas measured at 649° C. Generally conditioner levels below this range do not appreciably improve the collection characteristics of the particles, while any conditioner levels in excess of the specified range not only increase the cost of conditioning unnecessarily, but also increase the possibility of blockage of the preheater or other heat exchanger downstream of the point of injection.

The quantity of ammonium bisulfate determined according to the foregoing criteria is preferably added in the form of an atomized aqueous solution, preferably a 20-50% by weight salt solution. Higher or lower concentration may be used, however, as the function of the water is merely to facilitate injection of the ammonium bisulfate in atomized form into the gas stream, and the water itself is not believed to play a significant part in the process of the present invention.

The gas stream at the point of injection must have a temperature of 590°-900° C. It is recommended that the temperature not be in excess of 750° C for maximum economy. Injection of the conditioner into the gas stream within the specified temperature range does not result in subsequent salt deposits in and/or blockage of the air preheater means downstream for two specific reasons. First, the ammonium bisulfate has a boiling point of 490° C and is thus vaporized by the hot gas stream before it has an opportunity to reach the air preheater means. Were it not for the very brief residence times at these temperatures before the conditioning agent is swept downstream to cooler regions, it is quite probable that injection temperatures of less than 590° C (but still above 490° C) would also be effective. However, a safety margin of 100° C is generally necessary to allow time for the water (if injected as an aqueous solution) and ammonium bisulfate to vaporize completely. Second, the ammonium bisulfate as vapor is of such high efficiency within the specified temperature range that only a small quantity of the ammonium bisulfate need be injected. Indeed, when the gas stream is within the preferred range, the amount of conditioner required to effectively condition flue gas is typically only about a tenth of the amount needed when injecting the same conditioner into flue gas at temperatures well outside of the preferred range.

The mechanism by which the conditioner of the present invention changes the resistivity of the particles in the gas stream is not fully understood. One possible explanation is advanced in U.S. Pat. No. 3,523,407, i.e., that the entrained dust particles become enveloped in a film or coating of ammonium bisulfate. If that is, in fact, a correct interpretation of the mechanism, it still does not explain why in the method described in that patent large amounts of water (i.e., 40–80 gals/million cu. ft. of flue gas) are needed for optimum results. A large excess of water vapor is already present in the flue gas of the coal fired boiler referred to in this patent so that the water is not required to form ammonium bisulfate. This mechanism also does not explain why in the method described in that patent "the greater the amount of sulfur trioxide in the gas, the more water is needed to achieve the desired reaction."

Regardless of the operative mechanism the present improvement over the said patent is very significant. By increasing the minimum injection temperature from 400°–450° F (204°–232° C) to 1094° F (590° C), by changing from two and sometimes three injection systems to one, and by injecting ammonium bisulfate rather than ammonia and water, a better result is obtained at much less cost.

Another important advantage of the present invention arises out of the fact that the conditioner is effective irrespective of the chemical content of the gas being conditioned; that is, its effectiveness does not depend on dust particles or the gas including a particular initial chemical composition (such as an oxide of sulphur) to provide a chemical reaction which would then combine with the conditioner in situ to condition the particles. Such dependency upon an in situ chemical reaction was one shortcoming of the heretofore known practices which required the presence of definite amounts of other chemical constituents in the gas stream, such a dependency being especially significant in view of the current trend to low sulphur fuels.

The process of the present invention is effective to modify the resistivity of the particles entrained in the flue gas to $10^8$–$10^{10}$ohm-centimeters regardless of the initial resistivity characteristics of the particles. Interestingly, the use of the conditioner is beneficial even when the bulk resistivity of the entrained particles is already at the $10^8$–$10^{10}$ ohm-centimeters believed to be the optimum resistivity for collection of particles. While the reason for this phenomenon is not completely understood, it is believed to be based on the fact that while the bulk resistivity is an average of the resistivity of all the particles in the dust layer (which may, in fact, contain particles with both much higher and lower resistivities than the average), the collection efficiency is believed to be a function of the resistivity of the individual particles. Thus, the ability of the conditioner to raise the resistivity of low resistivity particles and to lower the resistivity of high resistivity particles, both to approximately the optimum resistivity, is believed to be extremely important for collection efficiency.

It will be recognized that a critical feature of the present invention is the injection of the conditioner into a gas stream having the proper temperature range. The gas temperature at the point of injection must be sufficiently high to insure substantial vaporization of the ammonium bisulfate prior to contact of the ammonium bisulfate with the air preheater means or any other heat exchange unit which the ammonium bisulfate might deposit upon and/or clog. When the gas stream at the point of injection is at least 590° C, the specified quantities of ammonium bisulfate vaporize with sufficient speed for this purpose. Of course, if there are not heat exchange units intermediate the point of injection and the precipitator, somewhat lower injection temperatures may be tolerated provided they are effective to vaporize most of the ammonium bisulfate prior to its contact with the precipitator. However, the presence of an air preheater means or other heat exchange unit intermediate the point of injection and the precipitator is preferred to insure complete and thorough mixing of the vaporized ammonium bisulfate with the particles entrained in the gas stream. In this instance, it is recommended that the injection amount and injection temperature be appropriately coordinated (within the ranges specified for the practice of the present invention) to insure the absence of deposits in and clogging of the heat exchange unit, higher injection amounts requiring higher injection temperatures according to the principles of the present invention.

In a typical power station, the flue gas produced by a coal fired boiler passes successively from the boiler through a secondary superheater, a reheater-superheater, a "ball-room", a primary superheater, an economizer, an air preheater, a precipitator, a stack, and ultimately passes into the atmosphere. The temperature of the gas stream entering the ball-room is typically slightly under 900° C., and the temperature of the gas stream leaving the primary superheater is typically slightly below 550° C. In this situation, the preferred location for the injection ports for the conditioner would be somewhere between the ball-room entry duct and a point within the primary superheater. However, it is to be understood that this is only an illustrative example and that boilers vary widely in design and operating conditions. The criteria for selection of the injection ports is primarily the temperature of the gas stream at such points. Other criteria include the selection of a location permitting good mixing of the conditioner (preferably atomized) with the gas stream and the absence of direct impingement of the conditioner on the boiler tubing as that might result in severe damage by thermally shocking the boiler tubing. Preferably, the injection ports are disposed so that the gas stream (containing the conditioner) subsequently passes through the air preheater or some other heat exchange unit to insure thorough mixing of the conditioner and the particles of the gas stream before the gas stream contacts the precipitator.

The apparatus for injecting the conditioner into the gas duct may be conventional in design. Apparatus for injecting the conditioner typically includes a supply of the conditioner, nozzle means communicating with the interior of the gas duct, and means connecting the conditioner supply to the nozzle means, such connecting means typically including means for forcing the conditioner through the nozzle, preferably as an atomized spray, and means for metering the amount of conditioner injected, typically in proportion to either the quantity of gas being conditioned or the quantity of coal being burned.

Preferably the conditioner is injected on a continuous basis during operation of the furnace, but clearly it may be alternatively injected on an intermittent or periodic basis.

The efficiency of an electrostatic precipitator can be determined by comparing the amount of particles or dust load released to the atmosphere from the precipitator outlet to the amount of particles or dust load entering the precipitator. The following equation gives precipitator efficiency as a percentage:

$$\text{Efficiency} = (P_I - P_O/P_I) \times 100$$

where $P_I$ is dust load at the precipitator inlet and $P_O$ is dust load at the precipitator outlet. The dust loads, usually expressed as grains per cubic foot of gas, are conveniently measured by the procedure given in EPA Method No. 5 as described in the Federal Register, Vol. 36, No. 247, Part II, pp. 24,888–24,890 (Dec. 23, 1971).

The following constructive examples illustrate the efficacy of the present invention and the relationship between the critical parameters thereof.

EXAMPLE I

A 500 Megawatt coal fired forced draft boiler with 2 Ljungstrom air heaters and an American Standard electrostatic precipitator is fueled with a low sulfur (approximately 1%) bituminous coal with an ash content of 10–15%. Various amounts of an aqueous solution of ammonium bisulfate are injected with the flue gas from the boiler through an injection port upstream of the air heaters (where the flue gas has an average temperature of 750° C), and the characteristic effect on the emission level is illustrated in FIG. 1.

FIG. 1 shows that while higher treatment rates within the range of the present invention give improved performance, at the upper treatment rate levels there are diminishing effects for increments in treatment rate. More important, at very high treatment levels, there exists the increased possibility of air heater pluggage.

EXAMPLE II

The boiler of EXAMPLE I is fed with the same fuel. An average level of 510 grams of finely divided ammonium bisulfate powder per metric ton of coal burned is injected into the flue gas from the boiler through various injection ports (each port being characterized by an average temperature of the flue gas passing thereby), and the characteristic effect on the emission level is illustrated in FIG. 2.

Figure 2:
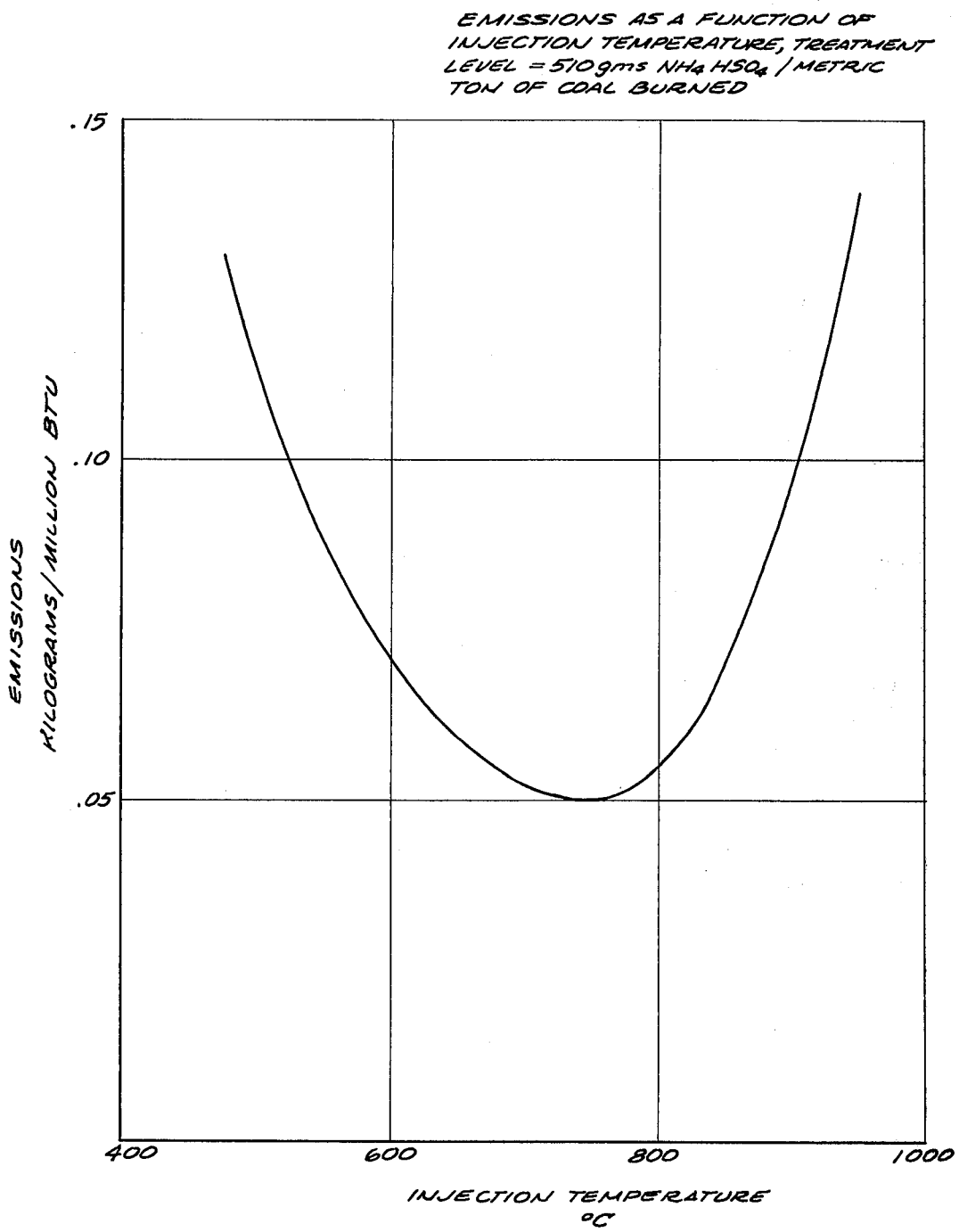
FIG. 2 is a graph illustrating the emission level (kilograms of emissions per million BTU produced) as a function of injection temperature (° C), at a constant treatment level of 510 grams $NH_4HSO_4$ per metric ton of coal burned.

FIG. 2 shows that in the optimum injection temperature range between the vaporization temperature of the conditioner (490° C.) and a temperature at which the ammonium bisulfate substantially decomposes to ineffective by-products (about 900° C.), there is substantial decrease in the emission level which would not be expected only from a consideration of the emission levels at the extremes of the optimum injection temperature range. Furthermore, this substantial decrease in emission level is obtained using a relatively low conditioner treatment level.

While the optimum treatment rate and injection temperature may vary somewhat with the type of dust, the composition of the carrier gas, and the design and operating conditions of the electrostatic precipitator used, since the effectiveness of ammonium bisulfate as a flue gas conditioning agent is essentially independent of the composition of either the carrier gas or the entrained particulate matter, it can readily be seen that the curves of FIGS. 1 and 2 are characteristic of the effect of adding ammonium bisulfate to a flue gas and are not specific to the particular set of circumstances described in the examples.

Now that the preferred embodiments of the present invention have been shown and described, various modifications and improvements thereon will become readily apparent to those skilled in the art. For example, the principles of the present invention are easily adapted for similarly conditioning the entrained dust or ash particles produced by oil-fired furnaces (petroleum by-product particles), catalytic crackers ($SiO_2$-$Al_2O_3$ particles), cement or lime kilns (calcium salt particles), electric furnaces (reduced copper particles), etc. Accordingly, the spirit and scope of the present invention is to be limited only by the appended claims, and not by the foregoing disclosure.

We claim:

1. A method of improving the collection characteristics of particles entrained in a stream of particle-laden gas formed by the burning of coal for collection by an electrostatic precipitator, comprising forming a mixture of A. the particle-laden gas at a temperature of 590°–900° C., and B. finely divided ammonium sulfate; said mixture containing 75–1250 grams of ammonium sulfate per metric ton of coal burned to form said gas, and C. after forming said mixture, directing said gas stream through a heat exchange means and into an electrostatic precipitator to collect said particles therein.

2. The method of claim 1 wherein said mixture contains 150–600 grams of ammonium bisulfate per metric ton of coal burned to form said gas.

3. The method of claim 1 wherein said ammonium bisulfate is mixed with said gas in the form of an aqueous solution and in sufficient quantity to provide 150–600 grams of ammonium bisulfate per metric ton of coal burned to form said gas.

4. The method of claim 1 wherein said gas is at a temperature of 590°–750° C. at the time said ammonium bisulfate is mixed therewith.

5. The method of claim 4 wherein said ammonium bisulfate is mixed with said gas in the form of an aqueous solution and in sufficient quantity to provide 150–600 grams of ammonium bisulfate per metric ton of coal burned to form said gas.

6. The method of claim 4 wherein said mixture contains 150–600 grams of ammonium bisulfate per metric ton of coal burned to form said gas.

7. The method of claim 1 wherein said ammonium bisulfate is mixed with said gas in the form of an aqueous solution.

8. The method of claim 7 wherein said aqueous solution comprises about 20–50 parts of ammonium bisulfate and 50–80 parts by weight of water.

9. The method of claim 7 wherein said mixture contains 150–600 grams of ammonium bisulfate per metric ton of coal burned to form said gas.

10. The method of claim 1 wherein said ammonium bisulfate is in the form of a dry powder.

11. The method of claim 10 wherein said mixture contains 150–600 grams of ammonium bisulfate per metric ton of coal burned to form said gas.

12. The method of claim 1 including the additional step of passing said mixture through heat exchange means.

13. The method of claim 12 wherein said ammonium bisulfate is mixed with said gas in the form of an aqueous solution and in sufficient quantity to provide 150–600 grams of ammonium bisulfate per metric ton of coal burned to form said gas.

14. A method of improving the collection characteristics of particles entrained in a stream of particle-laden gas formed by the burning of coal for collection by an electrostatic precipitator, comprising the steps of:

A. injecting finely divided ammonium bisulfate into said stream of particle-laden gas while said gas has a temperature of 590°–900° C., sufficient ammonium bisulfate being injected to provide 75–1250 grams of ammonium bisulfate per metric ton of coal burned to form said gas; and B. after said injection, directing said gas stream through a heat exchange means and into an electrostatic precipitator to collect said particles therein.

15. The method of claim 14 wherein said ammonium bisulfate is injected in the form of an aqueous solution and in sufficient quantity to provide 150–600 grams of ammonium bisulfate per metric ton of coal burned to form said gas.

16. The method of claim 14 wherein said gas is at a temperature of 590°–750° C. at the point of injection.

17. The method of claim 16 wherein 150–600 grams of ammonium bisulfate are injected per metric ton of coal burned to form said gas.

18. The method of claim 16 wherein said ammonium bisulfate is injected in the form of an aqueous solution and in sufficient quantity to provide 150–600 grams of ammonium bisulfate per metric ton of coal burned to form said gas.

19. The method of claim 14 wherein said ammonium bisulfate is injected in the form of an aqueous solution.

20. The method of claim 19 wherein said aqueous solution comprises about 20–50 parts of ammonium bisulfate and 50–80 parts by weight of water.

21. The method of claim 19 wherein 150–600 grams of ammonium bisulfate are injected per metric ton of coal burned to form said gas.

22. The method of claim 14 wherein said ammonium bisulfate is injected in the form of a dry powder.

23. The method of claim 22 wherein 150–600 grams of ammonium bisulfate are injected per metric ton of coal burned to form said gas.

24. The method of claim 14 wherein 150–600 grams of ammonium bisulfate are injected per metric ton of coal burned to form said gas.

25. A method of improving the collection characteristics of particles entrained in a stream of particle-laden gas formed by the burning of coal for collection by an electrostatic precipitator, comprising forming a mixture of A. the particle-laden gas at a temperature of 590°–900° C., and B. finely divided ammonium sulfate;

said mixture containing 2.46–41.1 kilograms of said ammonium sulfate per million cubic meters of said gas at 649° C., and thereafter directing said gas stream through a heat exchange means and into an electrostatic precipitator to collect said particles therein.

26. The method of claim 25 wherein said mixture contains 4.93–19.71 kilograms of said ammonium bisulfate per million cubic meters of said gas at 649° C.

27. A method of improving the collection characteristics of particles entrained in a particle-laden gas stream for collection by an electrostatic precipitator, comprising the steps of:

A. injecting finely divided ammonium bisulfate into a stream of particle-laden gas while said gas has a temperature of 590°–900° C., sufficient ammonium bisulfate being injected to provide 2.46–41.1 kilograms of ammonium bisulfate per million cubic meters of said gas at 649° C.; and B. after said injection, directing said gas stream through a heat exchange means and into an electrostatic precipitator to collect said particles therein.

28. The method of claim 27 wherein 4.93–19.71 kilograms of said ammonium bisulfate are injected per million cubic meters of said gas at 649° C.

* * * * *

UNITED STATES PATENT OFFICE

CERTIFICATE OF CORRECTION

Patent No. 4,042,348 Dated August 16, 1977

Inventor(s) Robert P. Bennett et al.

It is certified that error appears in the above-identified patent and that said Letters Patent are hereby corrected as shown below:

Claim 1, lines 8 and 9; and

Claim 25, lines 8 and 10, "sulfate" should read -- bisulfate --.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*

Disclaimer and Dedication 4,042,348.—*Robert P. Bennett,* Bridgewater; *Matthew J. O'Connor,* Flanders; *Alfred E. Kober,* Hopatcong, and *Ira Kukin,* West Orange, N.J. METHOD OF CONDITIONING FLUE GAS TO ELECTROSTATIC PRECIPITATOR. Patent dated Aug. 16, 1977. Disclaimer and Dedication filed Mar. 10, 1983, by the assignee, *Economics Laboratory, Inc.*

Hereby enters this disclaimer to all claims and dedicates to the Public the entire term of said patent.

[*Official Gazette October 4, 1983.*]